US005176979A

United States Patent [19]

Eguchi et al.

[11] Patent Number: 5,176,979

[45] Date of Patent: Jan. 5, 1993

[54] ELECTROPHOTOGRAPHIC TONER HAVING A SURFACE TREATED SILICA PARTICLE

[75] Inventors: Atuhiko Eguchi; Ikutaroh Nagatsuka; Takayoshi Aoki, all of Kanagawa, Japan

[73] Assignee: Fuji Xerox Co., Ltd., Tokyo, Japan

[21] Appl. No.: 745,261

[22] Filed: Aug. 14, 1991

[30] Foreign Application Priority Data

Aug. 21, 1990 [JP] Japan ..... 2-218200

[51] Int. Cl.[5] ..... G03G 9/08

[52] U.S. Cl. ..... 430/110; 430/111

[58] Field of Search ..... 430/110, 111, 903

[56] References Cited

U.S. PATENT DOCUMENTS 4,680,245 7/1987 Suematsu et al. ..... 430/110

5,041,351 8/1991 Kitamori et al. ..... 430/110

FOREIGN PATENT DOCUMENTS 55-135855 10/1980 Japan .

63-143562 6/1988 Japan .

*Primary Examiner*—John Goodrow

*Attorney, Agent, or Firm*—Finnegan, Henderson, Farabow, Garrett and Dunner

[57] ABSTRACT

A positively chargeable electrophotographic toner excellent in powder fluidity, circumstance dependency and durability is disclosed. The toner comprises a toner particle and a silica fine particle the surface of which is treated with a substantially water-insoluble or sparingly water-soluble quaternary ammonium salt compound.

7 Claims, No Drawings

ELECTROPHOTOGRAPHIC TONER HAVING A SURFACE TREATED SILICA PARTICLE

FIELD OF THE INVENTION

The present invention relates to positively chargeable toners for use in development of electrostatic images in an electrophotographic method, an electrostatic recording method, and so forth. These toners are hereinafter referred to "electrophotographic toners".

BACKGROUND OF THE INVENTION

Dry developers for use in the electrophotographic method and so forth are divided into two groups: one component developers in which there are used toners comprising a binder resin and a coloring agent dispersed therein; and two component developers in which the above toners are combined with carriers. In a copying operation using the developers, an electrostatic latent image formed on an electrophotographic photoreceptor, for example, is developed with the developer to from a toner image, which is then transferred, and toners remaining on the photoreceptor are removed by cleaning. Thus the dry developer is required to meet various requirements at the copying process, particularly a developing step and a cleaning step. Since the toners are applied to development not in the form of aggregated mass but in the form of divided particles, it is necessary that the toners have sufficient fluidity and are not changed in fluidity or electrical properties with a lapse of time or depending on conditions (temperature and humidity). In the case of the two component developer, it is necessary that the developer does not cause a so-called toner filming phenomenon that toners are firmly attached onto the surface of carriers. Moreover, in cleaning, it is required that the remaining toners can be easily removed from the surface of the photoreceptor, and that when a cleaning member such as a blade or a web is used, it does not damage the photoreceptor. In order to comply with these requirements, there have been various dry developers, one component developers or two component developers, in which inorganic fine powder such as silica, organic fine powder such as fatty acid and its derivative or metal salt, or fluorine-based resin fine powder is added to toners, so that fluidity, durability or cleaning properties are improved.

In connection with silica, it is known to use silica which has been made hydrophobic, and silica treated with an electric charge controlling substance as described in JP-A-55-135855 (the term "JP-A" as used herein means an "unexamined published Japanese patent application").

Although hydrophobic silica is greatly effective in increasing powder fluidity, its great negative chargeability produces a hindrance for use in positively chargeable toners. Thus it is described in the aforementioned JP-A-55-135855 that the silica is treated with an electric charge controlling substance which makes the toners positively chargeable. However, since dye is used as the electric charge controlling substance, the silica is colored and thus cannot be applied to color toners.

Thus it has been desired to develop silica particles which can be applied to color toners and further which meet requirements such as powder fluidity, cleaning properties, and positive charge stability.

SUMMARY OF THE INVENTION

An object of the present invention is to provide positively chargeable electrophotographic toners in which fine particles of silica are used, and which are excellent in powder fluidity, circumstance dependency and durability.

The present invention relates to a positively chargeable electrophotographic toner comprising a toner particle and a silica fine particle the surface of which is treated with a substantially water-insoluble or sparingly water-soluble quaternary ammonium salt compound.

DETAILED DESCRIPTION OF THE INVENTION

In the present invention, silica fine particles the surface of which has been made hydrophobic may also be used. The hydrophobic treatment can be carried out by treating silica fine particles with a coupling agent (e.g., silane coupling agent, titanate coupling agent, zirconium coupling agent, aluminum series coupling agent). Methods for the hydrophobic treatment are classified into a wet process and a dry process. The wet process comprises dispersing silica fine particles uniformly into an aqueous solution, alcohol solution or organic solvent solution of coupling agent which has been preliminarily adjusted and sufficiently stirred. In dispersing, a blender such as Henschel mixer and supermixer may be used. The dry process comprises the steps of dispersing silica fine particles into an alcohol solution, an aqueous solution, an organic solvent solution, etc., adding a coupling agent which has been preliminarily adjusted to the solution to remove alcohol, water, organic solvent, etc., and drying. Further, the dry process may comprise a heating step and a step for grinding the dried product.

Surface treated silica fine particles, which are to be added to toner particles, are obtained by treating silica fine particles having a diameter of 1 to 100 nm, preferably 5 to 50 nm with a quaternary ammonium salt compound which is substantially water-insoluble or sparingly water-soluble.

The definition "substantially water-insoluble or sparingly water-soluble" as used herein means that when a 10 time volume of water is added to the quaternary ammonium salt compound, white turbidity is caused, and furthermore that in filtration with a 0.1 μm membrane filter, the amount of the quaternary ammonium salt compound remaining on the filter is at least 90% by weight.

Quaternary ammonium salt compounds which can be used in the present invention are shown below.

1.

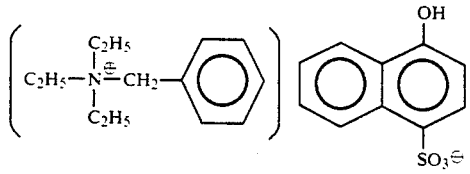

2.

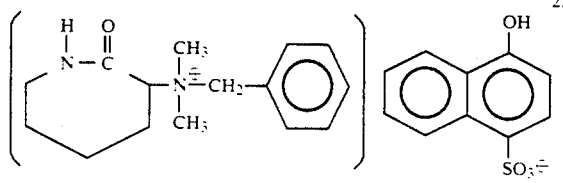

-continued

3.

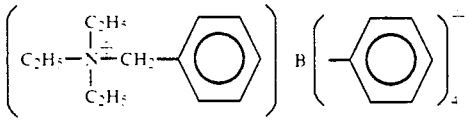

4.

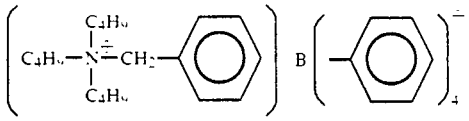

5.

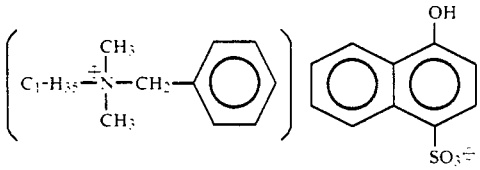

6.

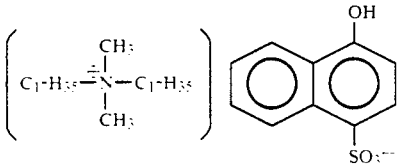

The water-insoluble or sparingly water-soluble quaternary ammonium salt compound is used in an amount of 0.01 to 100% by weight, preferably 0.5 to 70% by weight of the treated silica. Surface treatment of the silica fine particles with the quaternary ammonium salt compound can be carried out merely by mixing them mechanically. A method which comprises dissolving the quaternary ammonium salt compound in an appropriate solvent, coating the solvent onto the silica fine particles, and then drying the solvent is generally used for the treatment. As the solvents, methanol, ethanol, dimethylformamide, etc., are suitably used.

The surface treatment can be carried out at a heating atmosphere. In this heat treatment, acetone, trichloroethylene, methyl acetate, ethyl acetate, butyl acetate, amyl acetate, chloroform, propyl alcohol, methyl ethyl ketone, butanol, benzene, toluene, xylene, cyclohexanone, cyclohexanol, dioxane, cyclohexane, and methylcyclohexane may further be used as the solvents in addition to the abovedescribed ones. It is most preferred that the surface treatment is carried out at a room temperature. Further, a kneader coater, a spray drier, a thermal processor, a fluid bed, etc., may preferably be used to the treatment. If necessary, classification may be conducted after drying.

As silica fine particles, those particles which have been made hydrophobic with an agent to make hydrophobic, can be used. In addition, it is possible that the treatment to make hydrophobic is applied by using the agent to make hydrophobic, in the treatment with the quaternary ammonium salt compound.

Agents to make hydrophobic that can be used in the present invention include hexamethyldisilazine, dimethyldichlorosilane, and octyltrimethoxysilane.

As toner particles to be used in the present invention, known particles composed mainly of a binder resin and a coloring agent can be used.

Binder resins which can be used include homopolymers or copolymers of styrenes such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone. Typical examples are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. In addition, polyesters, polyurethanes, epoxy resins, silicone resins, polyamides, modified rosins, paraffin waxes and the like can be used.

Typical examples of the coloring agents for the toners are carbon black, Nigrosine dye, Aniline blue, Calco Oil Blue, Chrome yellow, Ultramarine Blue, Du Pont Oil Red, Quinoline Yellow, Methylene Blue Chloride, Phthalocyanine blue, Malachite green oxalate, Lampblack, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3.

To the toner particles of the present invention, if desired, known additives such as an electric charge controlling agent can be incorporated.

The toner particles of the present invention may be magnetic toners containing therein a magnetic material, or capsule toners.

In the present invention, toner particles having an average diameter of 3 to 20 μm are suitably used.

In the present invention, the above surface treated silica fine particles are added to and mixed with the toner particles. This mixing can be carried out, for example, by the use of a V-type blender or a Henschel mixer.

The amount of the surface treated silica fine particles added is preferably 0.01 to 10% by weight, more preferably 0.02 to 5% by weight of the total weight of the toners.

The state in which the surface treated silica fine particles are present on the toner particle surface may be such that the silica fine particles are mechanically attached onto the toner surface, or they are lightly fitted to the surface. The surface of the toner particle may be fully or partially covered with the silica fine particles. The silica fine particles may be provided in the form that they are partially aggregated, but it is preferred that they are covered in the form of monolayer particles.

The electrophotographic toners of the present invention, in which the surface treated silica fine particles are added, can be used as the one component developer or the two component developer.

In the case of the two component developer, the surface treated silica fine particles may be added when the toners and the carriers are mixed, in place of adding to the toner particles in advance, to thereby conduct the surface treatment simultaneously with the mixing of the toners and the carriers.

Carriers which can be used in the case of the two component developer, include iron powder, glass beads, ferrite powder, nickel powder, and those obtained by resin coating thereof.

In the electrophotographic toners of the present invention, since substantially water-insoluble or sparingly water-soluble quaternary ammonium salt compounds are used as the electric charge controlling agents, charging properties are improved without deteriorating good fluidity of silica fine powder. Since the quaternary ammonium salt compounds are substantially insoluble in water or sparingly soluble in water, the silica fine powder treated is not subject to changes in its characteristics even under high humidity conditions and, therefore, the effect of increasing charging properties in a stabilized manner can be obtained. Furthermore the quaternary ammonium salt compounds decrease a frictional force and improves the cleaning properties of the toner.

The electrophotographic toners of the present invention, although can be used appropriately depending on the dry process, is generally used in the process, such as electrophotography or electrostatic recording, that an electrostatic latent image is formed on an Image forming member and then made visible with a developer in a developing machine, the visible image thus obtained is transferred to an image receiving sheet, and toners remaining on the Image forming member for electrostatic latent image are removed by cleaning. As the electrostatic image forming member, known carriers such as a Se-based light-sensitive material, an amorphous silicon light-sensitive material, and those materials obtained by over coating of the surface thereof, can be used. As the developing machine, conventionally used two component or one component developing machines can be used.

Although the electrophotographic toners of the present invention have high fluidity, they exhibit more increased fluidity when used in a thin layer developing method in which a toner thin layer is formed on a developing roll, or a high speed developing method in which a latent image moving at a high speed is developed.

As the cleaning means, any known means, such as cleaning under blade pressure, or web fur brush cleaning, can be employed. In particular, when the cleaning under blade pressure is employed, more improved cleaning effect can be obtained.

The electrophotographic toners of the present invention are, as apparent by comparison of Examples and Comparative Examples, positively chargeable and improved in dependency on circumstances and durability without deteriorating powder fluidity of the toners, because silica fine particles which have been subjected to surface treatment with substantially water-insoluble or sparingly water-soluble quaternary ammonium salt compounds are added to toner particles.

The present invention is described in greater detail with reference to the following Examples and Comparative Examples. All parts are by weight.

EXAMPLE 1

Production of Toner Particles

| | |
|---|---|
| Styrene-butyl acrylate (80/20) copolymer | 100 parts |
| Carbon black (REGAL 330, produced by CABOT Corp.) | 10 parts |
| Low molecular weight polypropylene (VISCOL 660 P, produced by Sanyo Kasei Co., Ltd.) | 5 parts |

The above ingredients were melt kneaded in a Banbury mixer, cooled, finely ground in a jet mill, and classified by the use of a classifier to obtain toner particles having an average particle diameter of 11 μm.

Production of Surface Treated Silica

Two parts of a sparingly water-soluble quaternary ammonium salt compound (Compound (1)) was dissolved in 1,000 parts of ethyl alcohol, and in the solution thus obtained, 100 parts of silica fine particles having an average particle diameter of 16 nm were dispersed. This dispersion was treated by the use of a spray drier to remove the solvent, thereby obtaining the surface treated silica fine particles.

Preparation of Toners

To 100 parts of the toner particles were added 2 parts of the surface treated silica fine particles, which were then mixed and dispersed by the use of a Henschel mixer to obtain toners.

Preparation of Developer Composition

As the carrier, there was obtained a magnetic powder dispersion type carrier having an average particle diameter of 50 μm, which was obtained by melt kneading 30 parts of a styrene-butyl acrylate copolymer and 70 parts of magnetic powder (EPT 1000, produced by Toda Kogyo Co., Ltd.), pulverized, and then classified. The developer composition was prepared by mixing 90 parts of the carrier and 10 parts of the toner.

EXAMPLE 2

Toners and a developer composition were prepared in the same manner as in Example 1 except that as the sparingly water-soluble compound, Compound (3) was used in place Compound (1).

COMPARATIVE EXAMPLE 1

Toners and a developer composition were prepared in the same manner as in Example 1 except that the treatment with the sparingly water-soluble quaternary ammonium salt compound was not applied.

COMPARATIVE EXAMPLE 2

Toners and a developer composition were prepared in the same manner as in Example 1 except that the treatment was conducted with a water-soluble quaternary ammonium salt compound (obtained by replacement of the counter anion of Compound (1) with $Cl^-$) in place of the sparingly water-soluble ammonium salt compound.

COMPARATIVE EXAMPLE 3

Toners and a developer composition were prepared in the same manner as in Example 1 except that the treatment was conducted with Nigrosine in place of the sparingly water-soluble ammonium salt compound.

The developer compositions obtained in Examples 1 to 2 and Comparative Example 1 to 3 were subjected to a continuous copying test by the use of a copying machine (FX5075, produced by Fuji Xerox Co., Ltd.).

At the beginning of copy, after copying of 100,000 sheets under high temperature and high humidity (30° C., 90% RH), and after copying of 100,000 sheets under low temperature and low humidity (10° C., 15% RH), a charged amount, the density of a solid portion, and the density of the background were measured. In addition, the image quality was examined. The results are shown in Table 1.

The charged amount was measured by the use of a blow off measuring machine, and the density was measured by the use of a Macbeth densitometer.

In the column of evaluation, the symbol "A" indicates that charging and image density are satisfactory, and the symbol "C" indicates that there are problems in charging and image density.

While the invention has been described in detail and with reference to specific embodiments thereof, it will be apparent to one skilled in the art that various changes and modifications can be made therein without departing from the spirit and scope thereof.

TABLE 1

| | At the beginning of copying | | | After copying of 100,000 sheets under high temperature and high humidity | | | After copying of 100,000 sheets under low temperature and low humidity | | |
|---|---|---|---|---|---|---|---|---|---|
| | Charged amount (μC/g) | Density of solid portion | Density of back-ground | Charged amount (μC/g) | Density of solid portion | Density of back-ground | Charged amount (μC/g) | Density of solid portion | Density of back-ground |
| Example 1 | 22 | 1.61 | 0.0 | 18 | 1.50 | 0.0 | 23 | 1.49 | 0.0 |
| Example 2 | 18 | 1.58 | 0.0 | 19 | 1.49 | 0.0 | 21 | 1.48 | 0.0 |
| Com. Ex. 1 | 5 | 0.56 | 0.18 | — | — | — | — | — | — |
| Com. Ex. 2 | 18 | 1.59 | 0.01 | 5 | 0.64 | 0.21 | 15 | 1.32 | 0.11 |
| Com. Ex. 3 | 19 | 1.58 | 0.01 | 7 | 0.70 | 0.27 | 16 | 1.28 | 0.16 |

| | Image Quality | Evaluation |
|---|---|---|
| Example 1 | No formation of fog and black spots even at 100,000th sheet | A |
| Example 2 | No formation of fog and black spots even at 100,000th sheet. | A |
| Com. Ex. 1 | Formation of fog at the initial image, and no increase in image density. | C |
| Com. Ex. 2 | Formation of fog under high temperature and high humidity conditions, and serious decrease in image density. | C |
| Com. Ex. 3 | Formation of fog under high temperature and high humidity conditions, and serious decrease in image density. | C |

What is claimed is:

1. A positively chargeable electrophotographic toner comprising a toner particle and a silica fine particle the surface of which is treated with a substantially water-insoluble or sparingly water-soluble quaternary ammonium salt compound.

2. The electrophotographic toner as claimed in claim 1, wherein the surface of said silica fine particle is made hydrophobic.

3. The electrophotographic toner as claimed in claim 1, wherein said silica fine particle has a diameter of 1 to 100 nm.

4. The electrophotographic toner as claimed in claim 1, wherein said silica fine particle has a diameter of 5 to 50 nm.

5. The electrophotographic toner as claimed in claim 1, wherein said water-insoluble or sparingly water-soluble quaternary ammonium salt compound is used in an amount of 0.01 to 100% by weight of the treated silica.

6. The electrophotographic toner as claimed in claim 1, wherein said toner particle has a diameter of 3 to 20 μm.

7. The electrophotographic toner as claimed in claim 1, wherein the amount of said silica fine particle is 0.01 to 10% by weight of the total weight of the toner.

* * * * *